US007011503B2

(12) United States Patent
Christopherson et al.

(10) Patent No.: US 7,011,503 B2
(45) Date of Patent: Mar. 14, 2006

(54) FAN BLADE FOR ALLOWING AIRFLOW WITH FAN IN FAILURE CONDITION

(75) Inventors: Scott Lee Christopherson, Rochester, MN (US); Edward Charles Gillard, Mantorville, MN (US); Don Alan Gilliland, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 29 days.

(21) Appl. No.: 10/845,500

(22) Filed: May 13, 2004

(65) Prior Publication Data

US 2005/0254946 A1 Nov. 17, 2005

(51) Int. Cl.
*F04D 29/38* (2006.01)

(52) U.S. Cl. ..... 416/132 A; 416/40; 416/42; 416/231 R; 416/240; 361/695

(58) Field of Classification Search ..... 416/40, 416/42, 44, 131, 132 R, 132 A, 132 B, 231 R, 416/231 B, 2, 240; 361/695–697
See application file for complete search history.

(56) References Cited

U.S. PATENT DOCUMENTS 1,469,064 A * 9/1923 Zucker ..... 416/44

FOREIGN PATENT DOCUMENTS

GB 244385 A * 12/1925 ..... 416/231 B
GB 436101 A * 10/1935 ..... 416/231 B

* cited by examiner

*Primary Examiner*—Christopher Verdier
(74) *Attorney, Agent, or Firm*—Joan Pennington

(57) ABSTRACT

A fan and a fan blade are provided for allowing airflow through the fan blade in a fan failure condition. The fan blade includes a peripheral member defining an opening. A flexible cover member is attached to the peripheral member for covering the fan blade opening during normal operation of the fan. The flexible cover member is hingeably attached to the peripheral member for movement away from the peripheral member enabling airflow through the fan blade opening in a fan failure condition.

14 Claims, 2 Drawing Sheets

FAN BLADE FOR ALLOWING AIRFLOW WITH FAN IN FAILURE CONDITION

FIELD OF THE INVENTION

The present invention relates generally to an air moving device, such as, a fan for data processing systems, and more particularly, relates to a fan having a fan blade for allowing air flow through the fan blade in a fan failure condition.

DESCRIPTION OF THE RELATED ART

Various cooling arrangements have been used in data processing systems or computer systems. Often cooling arrangements use multiple cooling devices, such as multiple fans, blowers and other air moving devices.

For example, cooling devices for a particular system may include two or more fans located inline within an enclosure, each normally operating. To provide effective operation, failure of one of the fans should result in continued, substantially adequate cooling for the system.

However, with multiple conventional fans arranged inline, failure of one fan typically results in a significant drop in the cooling flow rate through the system components. A need exists for an effective mechanism to avoid such cooling problems from a fan failure when it is stacked in line with another fan or fans.

A need exists for a more efficient arrangement for cooling components in a computer system. The cooling operation should be highly reliable, and generally fault tolerant to a fan failure that is stacked in line with another fan or fans, and also be cost effective.

SUMMARY OF THE INVENTION

A principal aspect of the present invention is to provide a fan having a fan blade for allowing air flow through the fan blade in a fan failure condition. Other important aspects of the present invention are to provide such a fan and fan blade substantially without negative effect and that overcome many of the disadvantages of prior art arrangements.

In brief, a fan and a fan blade are provided for allowing airflow through the fan blade in a fan failure condition. The fan blade includes a peripheral member defining an opening. A flexible cover member is attached to the peripheral member for covering the fan blade opening during normal operation of the fan. The flexible cover member is hingeably attached to the peripheral member for movement away from the peripheral member enabling airflow through the fan blade opening in a fan failure condition.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
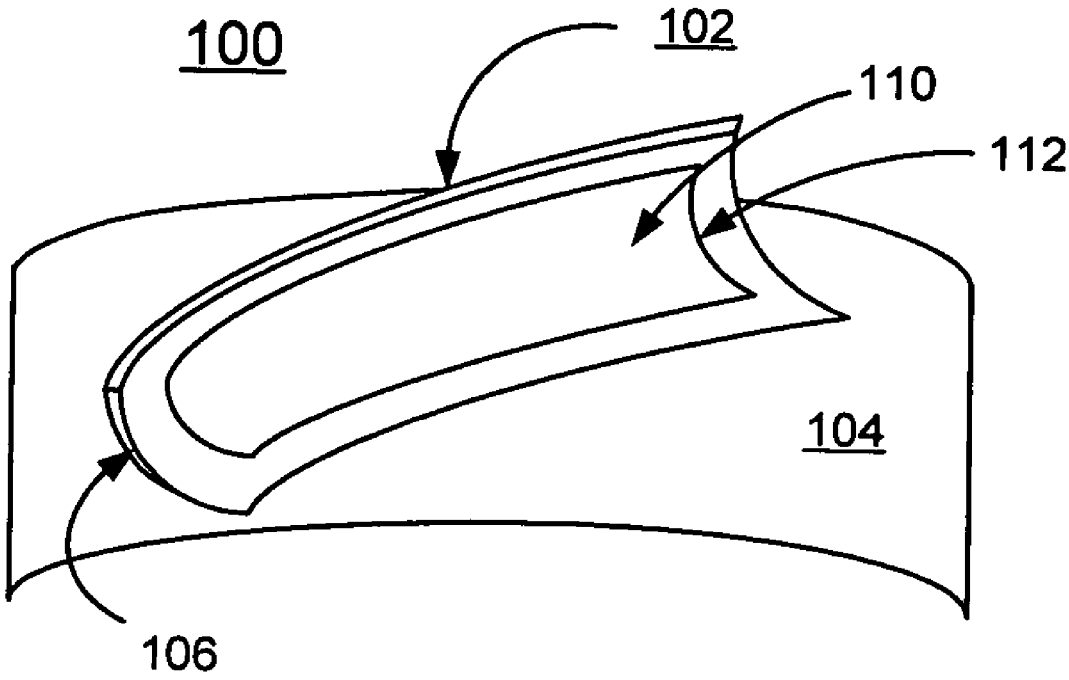
FIG. 1 is a perspective view of a portion of a fan illustrating an exemplary fan blade in accordance with the preferred embodiment.
Figure 2:
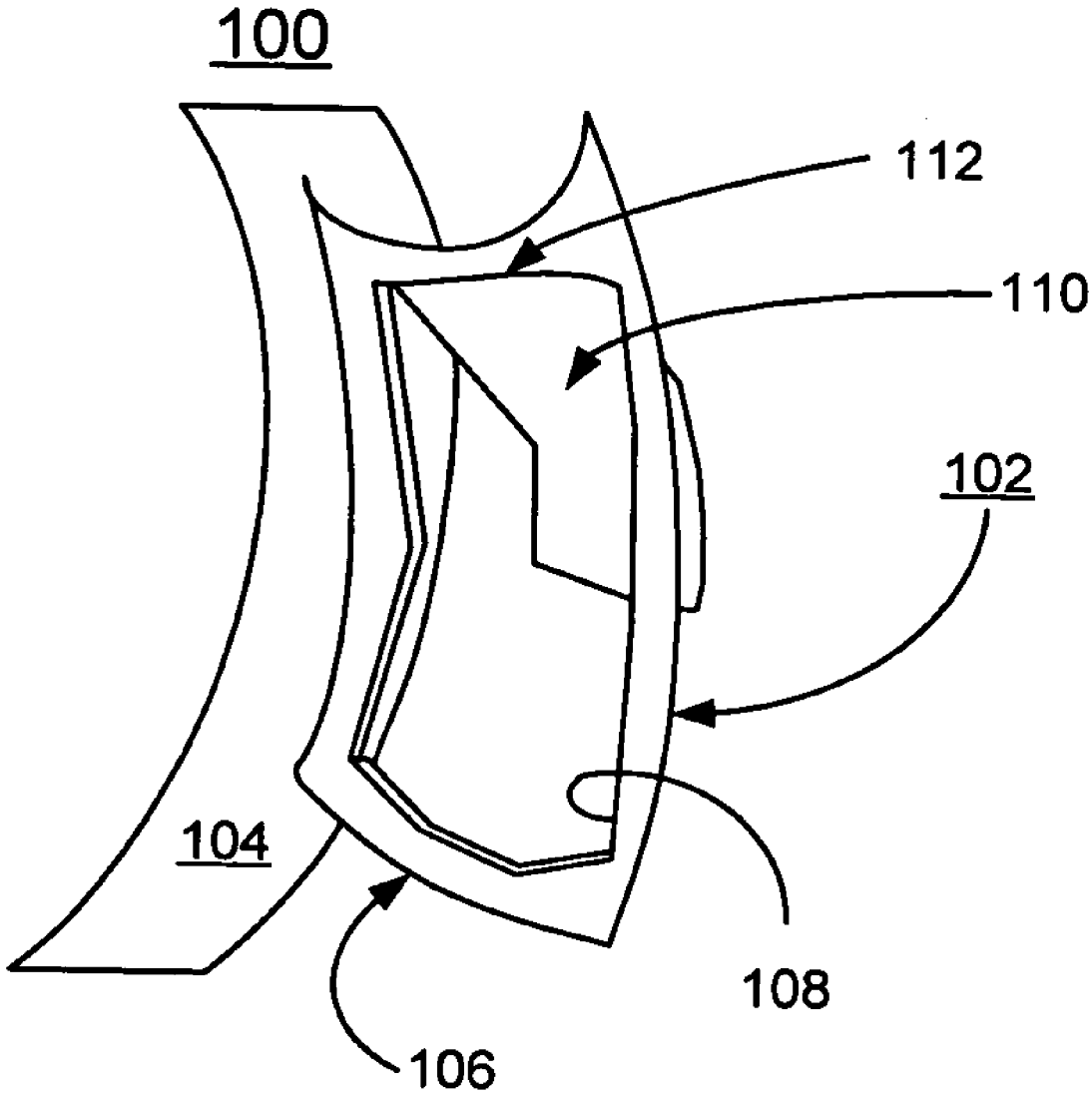
FIG. 2 is a perspective view illustrating the fan and exemplary fan blade of FIG. 1 in a fan failure condition allowing airflow though the stationary fan blade in accordance with the preferred embodiment.

Referring now to the drawings, in FIGS. 1 and 2 there is shown a fan generally designated by the reference character 100 including a fan blade 102 for allowing airflow through the fan blade in a fan failure condition. The fan 100 typically includes a plurality of fan blades 102. For example, multiple blades 102 are integrally formed spaced apart around a rotating hub 104. The fan blade 102 includes a frame 106 defining a generally centrally disposed, elongated opening 108. The frame 106 is a unitary member defining a periphery blade portion with the generally centrally disposed, elongated opening 108.

In accordance with features of the preferred embodiment, fan 100 is adapted for use together with one or more similar fans 100 located inline in an airflow path, for example, in a data processing system or computer system.

In accordance with features of the preferred embodiment, the fan blades 102 are arranged such that they move air as a normal fan blade when operating. If the fan fails and stops, the blades 102 allow airflow to pass through the blades, generally without hindering the airflow from a second fan behind or in front of fan 100, so that cooling is not substantially degraded.

The fan blades 102 are formed, for example, with each of the peripheral frame members 106 being constructed integral with the hub 104. A flexible cover member 110 then is attached to the peripheral frame member 106 that covers the void 108 defined in the fan blade 102 during normal operation of the fan 100 with the rotation operation of fan blades 102.

The flexible cover member 110 has a thickness substantially less than the fan blade peripheral member 106. The flexible cover member 110 is formed by a piece of selected flexible material 110, such as, a polyester sheet material, a flexible synthetic film material sold by E. I. Du Pont De Nemours and Company under the trademark MYLAR, or other similar flexible material.

The cover member 110 is hingeably attached onto a leading edge portion 112 of the frame member 106 of the fan blade 102. The leading edge portion 112 is the leading edge portion of the peripheral frame member 106 during normal rotation operation of the fan blade 102. The cover member 110 is securely attached to or fused together with the fan blade peripheral frame member 106 at the leading edge portion 112 of the fan blade 102, for example, with an adhesive, using heat, or with a selected one of various other known fastening techniques.

When the fan 100 is functioning properly, air pressure caused by the operation of the fan, forces the material 110 against the periphery member 106 of the fan blade 102, for cooling the system generally the same as a conventional fan blade.

In the event of a failure of one fan 100, then airflow passes through the respective opening 108 of all fan blades 102 of the failed or stopped fan. For example, if the front fan 100 in a fan stack fails, the air pressure from the rear fan will push the material 110 forward away from the frame 106 of the failed front fan blade 102 and allow more airflow than a conventional fan blade.

If the rear fan 100 fails, the material 110 is pulled open from the operation of the front fan, which will reduce the restriction of airflow that a normal fan blade would create, helping cool the system better until that failed fan 100 can be replaced.

This airflow path through the fan blades 102 of the failed fan 100 provides more efficient cooling for the system, until the failed fan 100 is replaced.

It should be understood that the illustrated fan blade 102 is provided in simplified form sufficient for understanding the present invention. The illustrated fan blade 102 is not intended to imply architectural or functional limitations.

It should be understood that fan blade 102 is not limited to the configuration as shown in FIGS. 1 and 2. The present invention can be used with various fan blade configurations. For example, it should be understood that fan blade 102 is not limited to the illustrated single opening 108, multiple openings and various patterns of openings could be provided.

Verification of operation has been performed as follows:

(1). An initial experiment was conducted that measured the airflow, separately, of two different fans.

(2). Then airflow was monitored with the two fans inline. First with the front fan running and the rear one stopped. Then with the front fan stopped and the rear one running. The results of these two scenarios were very similar, but lower than the fans singly as measured and described in (1) above.

(3). Then openings 108 were cut in the center of the blades 102 on one of the fans and a Mylar material 110 was attached to each blade in a fashion that the Mylar closed over the hole when this prototype fan 100 was operating and opened when the fan was stopped. Then measurements were taken with this fan 100 not running in front of the other conventional fan, which was running. Then the fans were switched so the prototype fan 100 was stopped and placed behind the operational conventional fan and measurements were taken. These two measurement numbers were similar. Also, these results indicated the airflow was raised back to the level of a single fan as measured and described in (1) above.

While the present invention has been described with reference to the details of the embodiments of the invention shown in the drawing, these details are not intended to limit the scope of the invention as claimed in the appended claims.

What is claimed is:

1. A fan for allowing airflow in a fan failure condition comprising:

a fan blade including a peripheral member defining an opening;

a flexible cover member attached to said peripheral member of said fan blade for covering said fan blade opening during normal operation of the fan; and said flexible cover member moving away from said peripheral member to enable airflow through said fan blade opening in a fan failure condition; said flexible cover member being hingeably attached onto an edge portion of said peripheral member; said edge portion being a leading edge portion of said peripheral member during normal rotation operation of the fan blade.

2. A fan as recited in claim 1 wherein said peripheral member is constructed integral with a fan hub.

3. A fan as recited in claim 1 wherein said flexible cover member is adhesively attached to said fan blade peripheral member.

4. A fan as recited in claim 1 wherein said flexible cover member has a thickness substantially less than said fan blade peripheral member.

5. A fan as recited in claim 1 wherein said flexible cover member is formed by a sheet material.

6. A fan as recited in claim 1 wherein said flexible cover member is formed by a polyester sheet material.

7. A fan as recited in claim 1 wherein said flexible cover member is formed of a flexible synthetic film material.

8. A fan as recited in claim 1 wherein said opening is a generally centrally disposed, elongated opening in the fan blade.

9. A fan blade for allowing airflow in a fan failure condition comprising:

a peripheral member defining an opening;

a flexible cover member attached to said peripheral member for covering said fan blade opening during normal rotation operation of the fan blade; and said flexible cover member moving away from the peripheral member allowing airflow through said fan blade opening when the fan blade is stationary during a fan failure condition; said flexible cover member is being formed by a flexible synthetic film material.

10. A fan blade as recited in claim 9 wherein said peripheral member is constructed integral with a fan hub.

11. A fan blade as recited in claim 9 wherein said flexible cover member is adhesively attached to said peripheral member.

12. A fan blade as recited in claim 9 wherein said opening is a generally centrally disposed, elongated opening.

13. A fan blade for allowing airflow in a fan failure condition comprising:

a peripheral member defining an opening;

a flexible cover member attached to said peripheral member for covering said fan blade opening during normal rotation operation of the fan blade; and said flexible cover member moving away from the peripheral member allowing airflow through said fan blade opening when the fan blade is stationary during a fan failure condition; said flexible cover member being attached to an edge portion of said peripheral member; said edge portion being a leading edge portion of said peripheral member during normal rotation operation of the fan blade.

14. A fan blade as recited in claim 13 wherein said flexible cover member is formed by a polyester sheet material.

* * * * *